US008034196B2

(12) United States Patent
Iwata et al.

(10) Patent No.: US 8,034,196 B2
(45) Date of Patent: Oct. 11, 2011

(54) LOW CORE LOSS GRAIN-ORIENTED ELECTRICAL STEEL PLATE AND METHOD OF MANUFACTURING THE SAME

(75) Inventors: Keiji Iwata, Tokyo (JP); Hideyuki Hamamura, Tokyo (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 12/808,354

(22) PCT Filed: Feb. 13, 2009

(86) PCT No.: PCT/JP2009/052414

§ 371 (c)(1),
(2), (4) Date: Jun. 15, 2010

(87) PCT Pub. No.: WO2009/104521

PCT Pub. Date: Aug. 27, 2009

(65) Prior Publication Data

US 2010/0279141 A1 Nov. 4, 2010

(30) Foreign Application Priority Data

Feb. 19, 2008 (JP) ..... 2008-037541

(51) Int. Cl.
*H01F 1/16* (2006.01)

(52) U.S. Cl. ..... 148/308; 148/111

(58) Field of Classification Search ..... None
See application file for complete search history.

(56) References Cited

U.S. PATENT DOCUMENTS

| | | | | |
|---|---|---|---|---|
| 4,293,350 | A | 10/1981 | Ichiyama et al. | |
| 4,456,812 | A * | 6/1984 | Neiheisel et al. | 219/121.85 |
| 4,552,596 | A | 11/1985 | Ichiyama et al. | |
| 4,750,949 | A * | 6/1988 | Kobayashi et al. | 148/111 |
| 4,770,720 | A | 9/1988 | Kobayashi et al. | |

FOREIGN PATENT DOCUMENTS

| | | | |
|---|---|---|---|
| JP | 55-18566 | A | 2/1980 |
| JP | 61-117218 | A | 6/1986 |
| JP | 7-320921 | A | 12/1995 |
| JP | 2000-169946 | A | 6/2000 |
| JP | 2003-301272 | A | 10/2003 |
| JP | 2004-342679 | A | 12/2004 |
| JP | 2005-248291 | A | 9/2005 |

OTHER PUBLICATIONS

International Search Report, dated May 19, 2009, issued in corresponding PCT/JP2009/052414.

* cited by examiner

*Primary Examiner* — John Sheehan
(74) *Attorney, Agent, or Firm* — Birch, Stewart, Kolasch & Birch, LLP

(57) ABSTRACT

A grain-oriented electrical steel plate is characterized in that grooves having a width of 10 μm to 200 μm and a depth of 10 μm to 30 μm exist in at least one of a front surface and a rear surface of a steel plate at intervals of 1 mm to 10 mm, an angle between a direction in which the grooves extend and a rolling direction of the steel plate is 60 degrees to 120 degrees, and tensile stresses having a maximum value of 20 MPa to 300 MPa act in the rolling direction within ranges of 10 μm to 300 μm from side surfaces of the grooves.

8 Claims, 7 Drawing Sheets

LOW CORE LOSS GRAIN-ORIENTED ELECTRICAL STEEL PLATE AND METHOD OF MANUFACTURING THE SAME

TECHNICAL FIELD

The present invention relates to a low core loss grain-oriented electrical steel plate suitable for an iron core of a transformer and the like, and a method of manufacturing the same.

BACKGROUND ART

A grain-oriented electrical steel plate having an easy magnetization axis in a rolling direction of a steel plate has been used for an iron core of a power converter such as a transformer. A low core loss property has been required strongly for a material of the iron core in order to reduce loss to be caused at the time of energy conversion.

The core loss of an electrical steel plate is classified into a hysteresis loss and an eddy current loss roughly. The hysteresis loss is affected by a crystal orientation, a defect, a grain boundary, and so on. The eddy current loss is affected by a thickness, an electrical resistance value, a 180-degree magnetic domain width, and so on.

Then, in manufacturing the electrical steel plate, arts in which crystal grains are aligned highly in the orientation of (110)[001] and crystal defects are reduced have been employed in order to reduce the hysteresis loss. Further, in order to reduce the eddy current loss, arts in which a thickness of the electrical steel plate is thinned, an electrical resistance value is increased, and a 180-degree magnetic domain is subdivided have been employed. An increase in Si content or the like has been performed for the increase in the electrical resistance value, and coating of a tension film on a surface of the electrical steel plate or the like has been performed for the subdivision of the 180-degree magnetic domain.

In recent years, in order to reduce the core loss drastically, there also has been proposed an art in which in addition to the application of tension to the surface of the electrical steel plate in order to drastically reduce the eddy current loss, which occupies most of the core loss, a groove and/or a strain is/are artificially introduced into the surface of the electrical steel plate and further the 180-degree magnetic domain is subdivided.

For example, in Patent Document 1 and the like, there is described an art in which a laser beam is emitted in a direction perpendicular to a rolling direction of a surface of a grain-oriented electrical steel plate with a predetermined beam width and energy density, and at predetermined emitting intervals, thereby introducing a local strain into the surface.

In Patent Document 2, there is disclosed an art in which a groove is formed in a predetermined direction of a surface of a grain-oriented electrical steel plate with a predetermined load, and then fine crystal grains are generated in a strain introduction section by strain relief annealing.

In Patent Document 3, there is disclosed an art in which a groove having a predetermined depth is mechanically formed with a roller with a groove or the like in a predetermined direction of a grain-oriented electrical steel plate in which annealing has been performed, and thereafter by etching, fine grains caused by mechanical strain are removed to deepen the groove.

In Patent Document 4, there is disclosed an art in which grooves are periodically formed in a surface of a grain-oriented electrical steel plate in which a finish annealing film has been removed, and thereafter a tension film is applied thereto.

In Patent Document 5, there is disclosed an art in which an interval and an angle of a groove to be formed in a surface of a directional electrical steel plate are limited within a predetermined range.

These arts described in Patent Documents 1 to 5 presuppose that a film is formed on a surface of an electrical steel plate. That is, the formation of a film is indispensable.

However, there is sometime a case that a magnitude of tension of the film cannot be obtained sufficiently due to variation in manufacturing processes. Then, in the above case, a favorable core loss property cannot be obtained. As measures against this case, coating the film thickly is also performed, but thickening the film leads to an increase in a nonmagnetic layer inevitably, resulting that a magnetic flux density is lowered. Consequently, at the time of manufacturing a transformer, a necessity of using the electrical steel plate more is created, resulting that weight is increased and cost is increased.

Patent Document 1: Japanese Patent Application Laid-open No. Sho 55-18566

Patent Document 2: Japanese Patent Application Laid-open No. Sho 61-117218

Patent Document 3: Japanese Patent Application Laid-open No. 2000-169946

Patent Document 4: Japanese Patent Application Laid-open No. 2003-301272

Patent Document 5: Japanese Patent Application Laid-open No. Hei 7-320921

SUMMARY OF THE INVENTION

An object of the present invention is to provide a low core loss grain-oriented electrical steel plate capable of obtaining a favorable core loss property even in the case when tensile tension from a film is not sufficient, and a method of manufacturing the same.

A grain-oriented electrical steel plate according to the present invention is characterized in that grooves having a width of 10 μm to 200 μm and a depth of 10 μm to 30 μm exist in at least one of a front surface and a rear surface of a steel plate at intervals of 1 mm to 10 mm, an angle between a direction in which the grooves extend and a rolling direction of the steel plate is 60 degrees to 120 degrees, and tensile stresses having a maximum value of 20 MPa to 300 MPa act in the rolling direction within ranges of 10 μm to 300 μm from side surfaces of the grooves.

A method of manufacturing a grain-oriented electrical steel plate according to the present invention includes: obtaining a steel plate in which grooves having a width of 10 μm to 200 μm and a depth of 10 μm to 30 μm exist in at least one of a front surface and a rear surface of the steel plate at intervals of 1 mm to 10 mm and an angle between a direction in which the grooves extend and a rolling direction of the steel plate is 60 degrees to 120 degrees; and irradiating the surface of the steel plate where the grooves are formed with a laser beam and acting tensile stresses having a maximum value of 20 MPa to 300 MPa in the rolling direction within ranges of 10 μm to 300 μm from side surfaces of the grooves.

DETAILED DESCRIPTION OF THE PREFERRED EMBODIMENTS

The present inventors have conducted a confirmatory test with regard to a conventional art in which a formation of a groove in or an introduction of strain into and coating of a film on a surface of a grain-oriented electrical steel plate are combined, for reducing a core loss, and have found the following problems.

Figure 1:
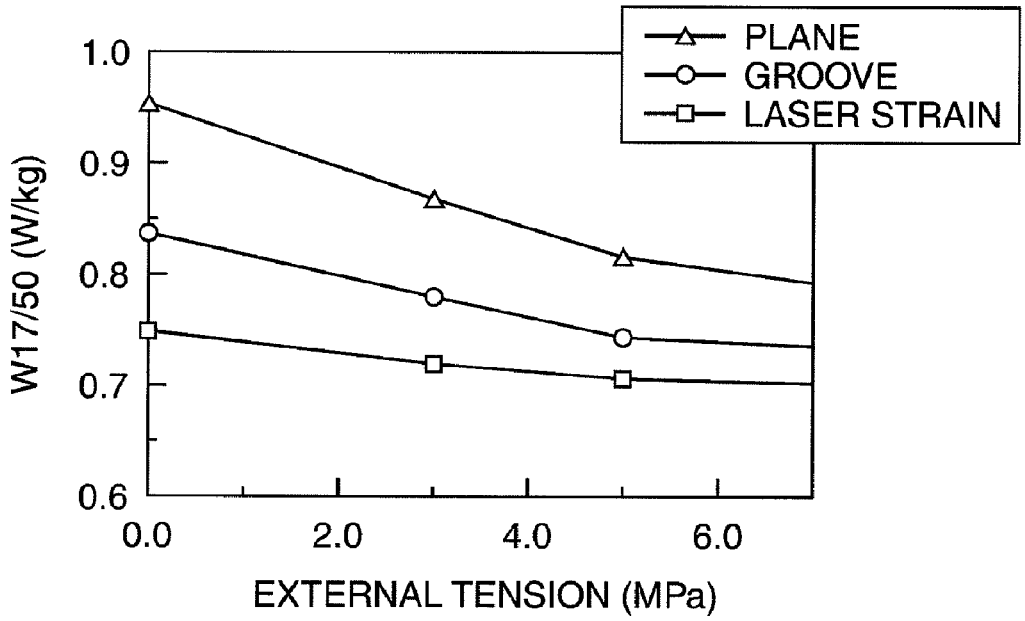
FIG. 1 is a graph showing relationships between external tensions and core losses in grain-oriented electrical steel plates.

FIG. 1 is a graph showing relationships between external tensions and core losses in conventional grain-oriented electrical steel plates.

"Plane" in FIG. 1 shows a relationship in a grain-oriented electrical steel plate in which a finish annealing film is removed, and "groove" shows a relationship in a grain-oriented electrical steel plate in which a finish annealing film is removed and a groove is formed in a surface, and "laser strain" shows a relationship in a grain-oriented electrical steel plate in which a finish annealing film is removed and strain is introduced into an entire surface by emission of a laser beam without forming a groove.

As shown in FIG. 1, the core loss is reduced by the formation of a groove or the introduction of strain, and further in either way, the more the external tension acting on an entire steel plate is increased by an external stress, the more the core loss is reduced. As for a conventional grain-oriented electrical steel plate that has been manufactured, by a film coated on the surface thereof, a stress acts on the grain-oriented electrical steel plate, and a magnitude of the stress corresponds to an external tension of about 5 MPa in FIG. 1.

However, due to a limit of adhesion of the film to the grain-oriented electrical steel plate or the like, it is difficult to obtain an external tension of 5 MPa or more in a stabilized manner. Further, due to variation in manufacturing processes or the like, there is sometimes a case that a surface property as designed, namely a sufficient external tension is not obtained and therefore a favorable core loss property cannot be obtained. Thus, in the conventional art in which the formation of a groove in or the introduction of strain into and the coating of a film on a surface of a grain-oriented electrical steel plate are combined, it is difficult to manufacture a grain-oriented electrical steel plate having a low core loss in a stabilized manner.

Figure 2:
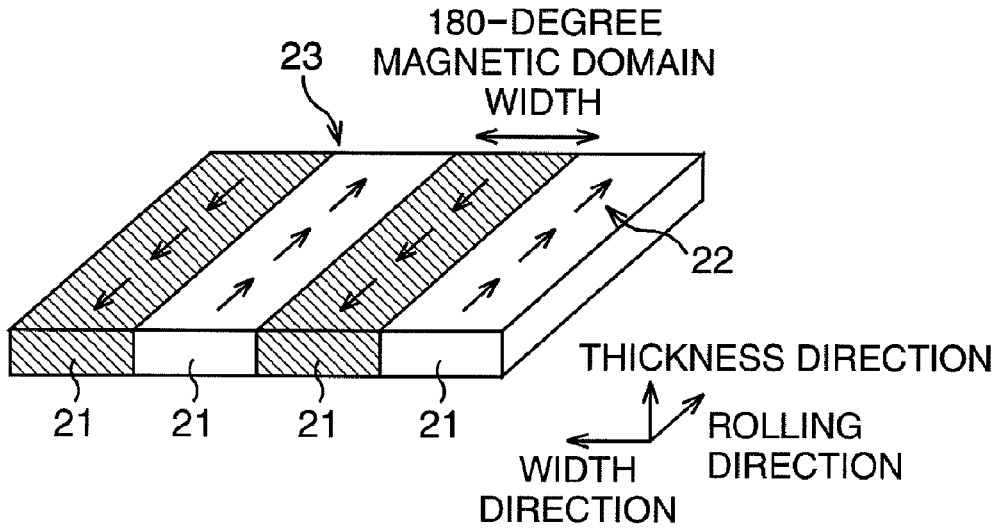
FIG. 2 is a view showing a magnetic domain structure generated in a steel plate.

Next, an embodiment of the present invention will be explained. FIG. 2 is a view showing a magnetic domain structure generated in a steel plate. In general, an easy magnetization axis of a grain-oriented electrical steel plate is directed toward a rolling direction, so that a magnetic domain 21 is composed of magnetization 22 parallel or anti-parallel to the rolling direction. Then, on a boundary between the magnetic domains 21 where directions of the magnetizations 22 are opposite to each other, a 180-degree magnetic domain wall 23 exists. Further, a dimension of the magnetic domain in a direction perpendicular to the rolling direction, (which is a plate width direction), is called a 180-degree magnetic domain width. When a groove extending in the plate width direction is formed in a surface of the grain-oriented electrical steel plate, the 180-degree magnetic domain width narrows and the magnetic domains are subdivided. The subdivision of the magnetic domains reduces a moving distance of the magnetic domain wall, so that an eddy current loss to be induced with the movement of the magnetic domain wall is reduced.

Figure 3:
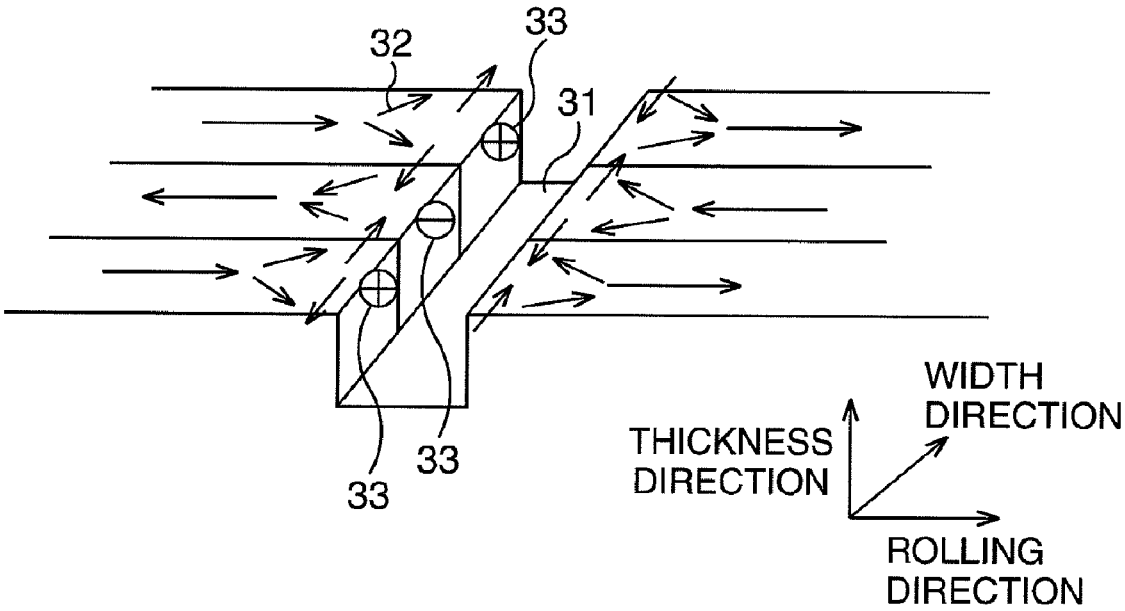
FIG. 3 is a view showing a magnetic domain structure in a grain-oriented electrical steel plate having a groove formed therein.

As a result that the present inventors have examined a mechanism of the subdivision of the magnetic domains by the formation of the groove from a magnetic domain structure analysis, the present inventors have found that, as shown in FIG. 3, magnetic poles 33 occur on a side surface of a groove 31 and the magnetic poles 33 urge restructuring of magnetic domains 32, resulting that 180-degree magnetic domains are subdivided. Further, the present inventors also have found that as shown in FIG. 3, diversions of magnetizations 32 are caused in the vicinity of the groove 31 and thus the occurrence of the magnetic poles 33 is weakened.

Figure 4:
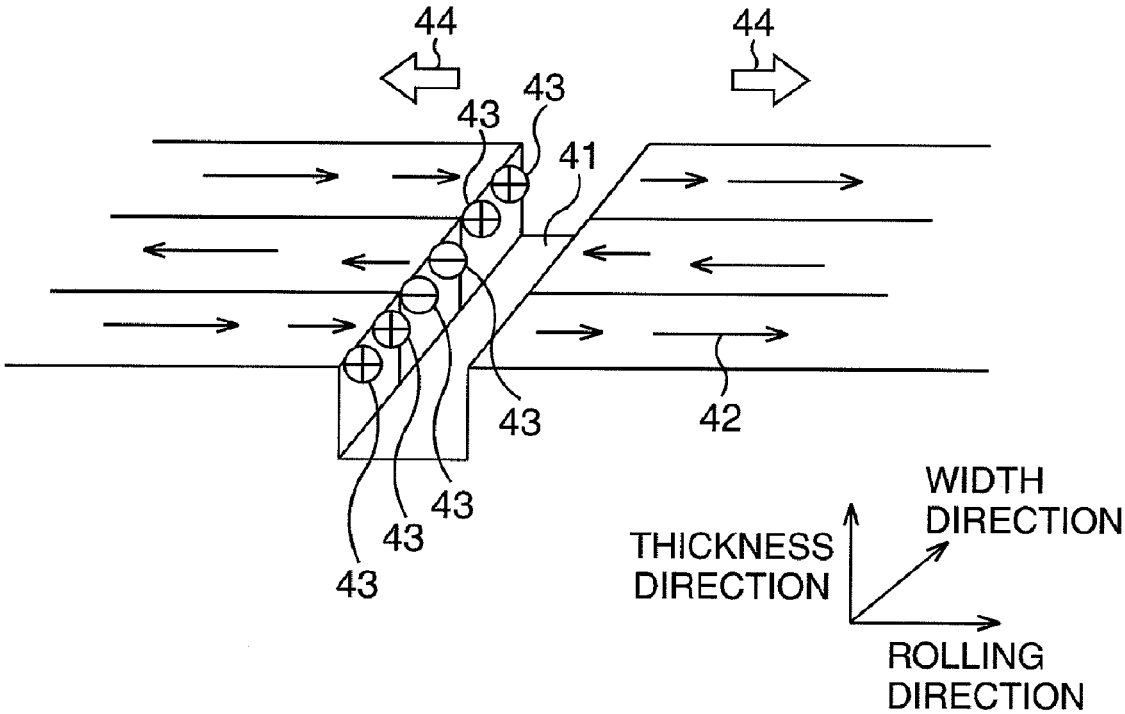
FIG. 4 is a view showing a relationship between stresses and restructuring of a magnetic domain structure in an embodiment of the present invention.

Thus, in the embodiment of the present invention, as shown in FIG. 4, tensile stresses 44 parallel to the rolling direction are applied to local portions in the vicinity of a groove 41. As a result, diversions of magnetizations 42 are suppressed, the proportion of the magnetizations 42 toward a direction perpendicular to a side surface of the groove 41 is increased, and occurrence of magnetic poles 43 on the side surface of the groove 41 is strengthened.

Figure 5:
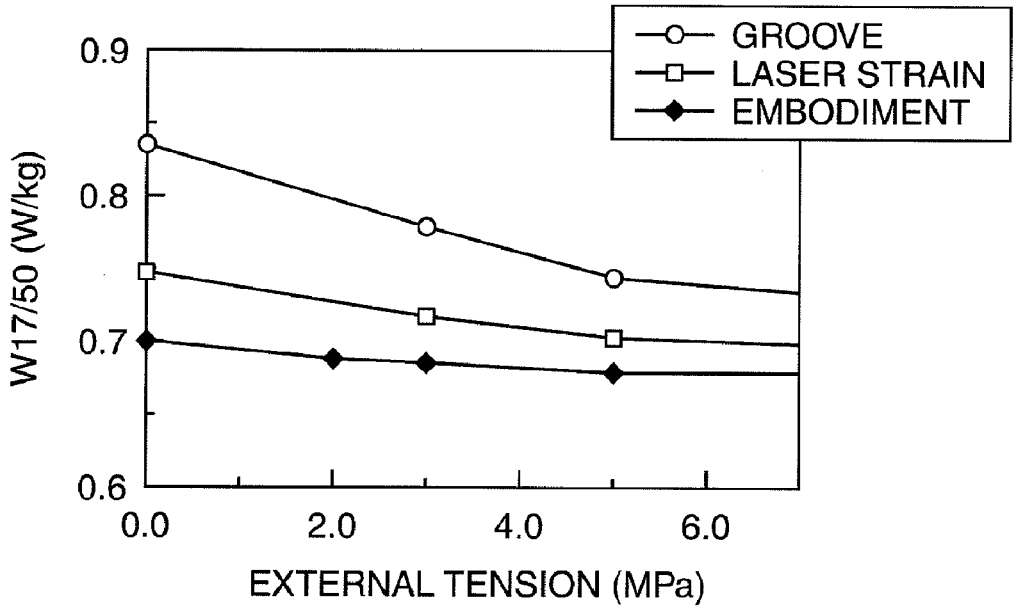
FIG. 5 is a graph showing relationships between external tensions and core losses in the embodiment of the present invention and conventional steel plates.
Figure 6:
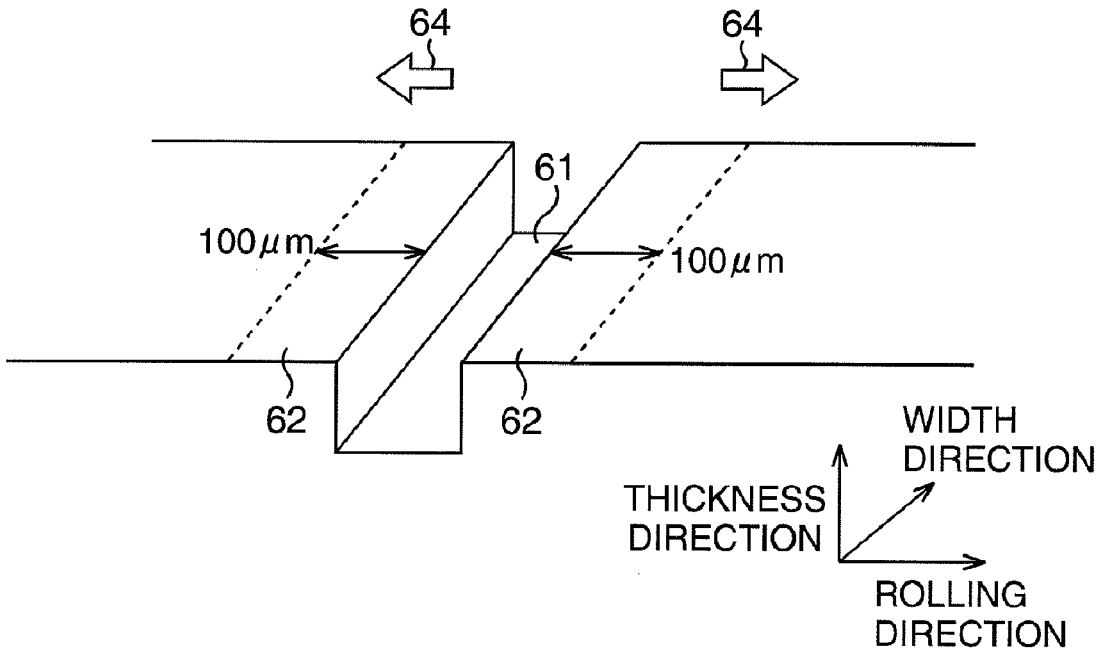
FIG. 6 is a view showing ranges where tensile stresses are introduced by emission of a laser beam.

FIG. 5 is a graph showing a relationship between a core loss W17/50 (a frequency of 50 Hz, a magnetic flux density of 1.7 T) and an external tension in a grain-oriented electrical steel plate according to an embodiment of the present invention. Note that the grain-oriented electrical steel plate according to the embodiment of the present invention was manufactured as follows. First, a finish annealing film was removed from a surface of the grain-oriented electrical steel plate, and a groove 61 having a width of 100 μm and a depth of 20 μm was formed in the surface having no film provided thereon perpendicularly to the rolling direction at intervals of 5 mm. Next, as shown in FIG. 6, YAG pulse laser beams were emitted parallel to a groove 61 within regions 62 of ranges of 100 μm from side surfaces of the groove 61 in the surface, and tensile stresses 64 having a maximum value of about 120 MPa parallel to the rolling direction are applied to the regions 62. In emitting the YAG pulse laser beam, a pulse energy E, a C-direction pitch Pc, and an L-direction pitch PL were appropriately adjusted so that emission energy Ua became 0.5 $mJ/mm^2$ to 3.0 $mJ/mm^2$ and a diameter $\phi$ of a condensing spot becomes 0.2 mm to 0.5 mm. The emission energy Ua is expressed by "Ua=E/(Pc×PL)". Note that a value of the stresses acting on the surface of the grain-oriented electrical steel plate can be calculated by using a strain of a crystal lattice measured by an X-ray diffractometry or the like, an elastic modulus of the grain-oriented electrical steel plate and so on.

In FIG. 5, besides the embodiment of the present invention, the relationships in the "laser strain" and the "groove" in FIG. 1 are also shown for a comparison purpose. As described above, on the grain-oriented electrical steel plates that have been manufactured, the stresses corresponding to the external tension of about 5 MPa act by the coating of a film. Thus, the core loss of a conventional grain-oriented electrical steel plate in which the groove is formed and further the film is coated is about 0.75 W/kg, and the core loss of a conventional grain-oriented electrical steel plate in which the strain is introduced by emitting the laser beam and further the film is coated is about 0.7 W/kg. In contrast, in the embodiment of the present invention, even in a state where the external tension does not act, namely a state where the film is not coated as well, the core loss is about 0.7 W/kg. This means that in the embodiment of the present invention, it is possible to reduce the core loss to be equal to or less than the core loss of the conventional grain-oriented electrical steel plate in which the core loss is reduced by not only the groove or strain but also the film even in a state where the film is not coated. Thus, even though the stresses corresponding to the external tension of 5 MPa or so cannot be obtained due to variation in manufacturing process or the like in the case when the film is coated on the embodiment of the present invention, the core loss can be reduced securely.

In this manner, in the embodiment of the present invention, the groove is formed in the surface, and the tensile stresses are locally introduced into a surface layer of the vicinity of the groove by the emission of the laser beam or the like. As a result, a quantity of magnetic poles to occur on the side surface of the groove is increased, the restructuring of magnetic domains is urged, 180-degree magnetic domains are subdivided, and an eddy current loss is reduced. Note that the surface layer indicates a portion having a depth of 20 μm or so from the surface of the electrical steel plate, for example.

Next, conditions with regard to the groove and the tensile stresses for securely obtaining an effect of the present invention will be explained. That is, the depth and the width of the groove, the ranges of the regions where the tensile stresses are applied, and a range of a magnitude of the tensile stresses or the like will be explained.

Figure 7:
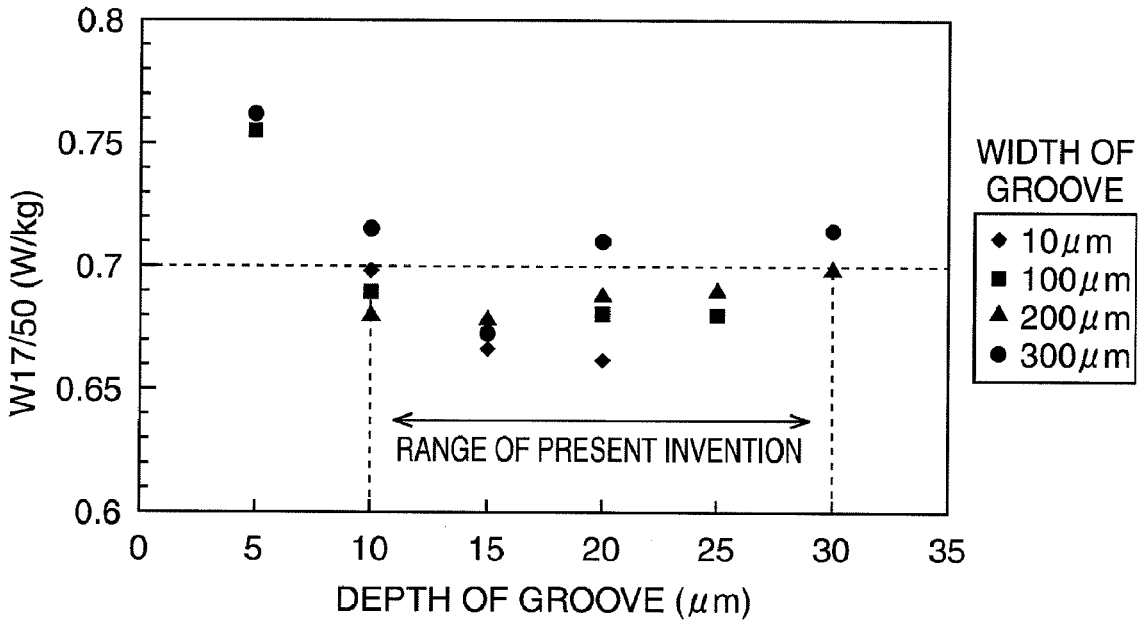
FIG. 7 is a graph showing a relationship between a depth of a groove and a core loss.

The present inventors investigated a relationship between a depth of a groove and a core loss in a grain-oriented electrical steel plate in which tensile stresses were applied to the vicinity of the groove. In this investigation, in manufacturing the grain-oriented electrical steel plates, a finish annealing film was removed and the groove 61 was formed at intervals of 5 mm, and thereafter, as shown in FIG. 6, the YAG pulse laser beams were continuously emitted parallel to the groove 61 within the regions 62 of the ranges of 100 μm from the side surfaces of the groove 61, and the tensile stresses 64 having the maximum value of 150 MPa parallel to the rolling direction were applied to the regions 62. Note that the direction in which the groove 61 extended was set as the direction perpendicular to the rolling direction, (which is the plate width direction). Then, the core losses in the various grain-oriented electrical steel plates in which the widths and the depths of the groove 61 differed were measured. A result thereof is shown in FIG. 7. FIG. 7 is a graph showing relationships between the depths of the groove and the core losses in the grain-oriented electrical steel plates in which the tensile stresses are applied to the vicinity of the groove.

From the result shown in FIG. 7, it is found that in the case when the width of the groove is 10 μm to 200 μm, the core loss is reduced in particular in a range where the depth of the groove is 10 μm to 30 μm. When the width of the groove exceeds 200 μm, the core loss is increased. This is because a nonmagnetic portion of the groove is increased and the magnetic flux density is lowered. Further, when the depth of the groove exceeds 30 μm, the core loss is increased due to the similar reason.

Incidentally, the reason why the width of the groove was set to be 10 μm or higher is because it was not easy to manufacture a groove having a width that was less than 10 μm in a stabilized manner.

Thus, in the present invention, the width of the groove to be formed in the surface is equal to or less than 200 μm, and the depth of the groove is 10 μm to 30 μm, and the width of the groove is preferable to be equal to or more than 10 μm.

Figure 8:
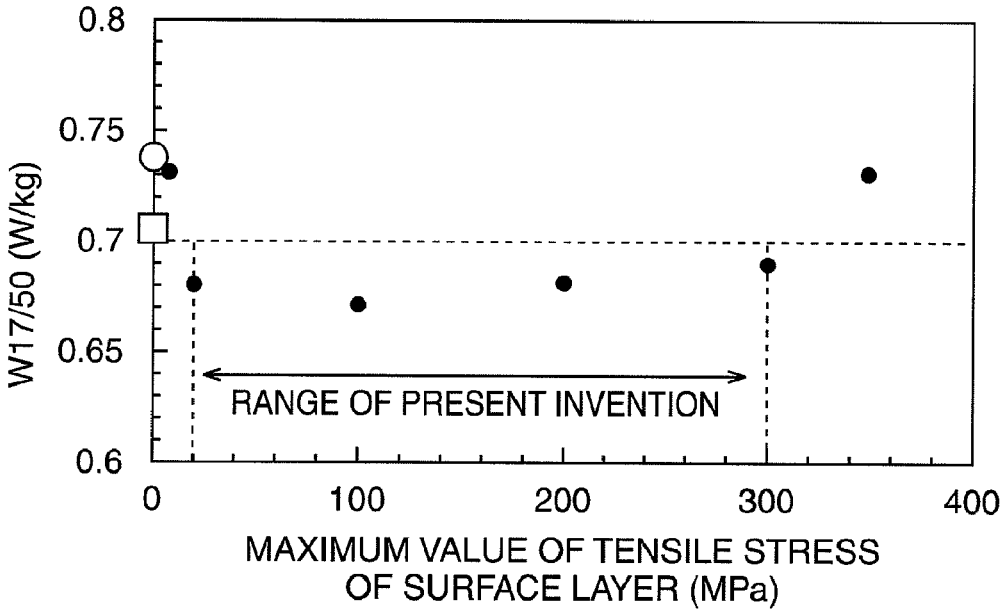
FIG. 8 is a graph showing a relationship between a maximum value of a tensile stress and a core loss.

The present inventors investigated a relationship between a maximum value of a tensile stress and a core loss in a grain-oriented electrical steel plate in which tensile stresses were applied to the vicinity of a groove. In this investigation, in manufacturing the grain-oriented electrical steel plates, the groove 61 was formed and the tensile stresses 64 were applied, by a method similar to that of the above-described investigation. Here, the width of the groove 61 was set to be 100 μm and the depth of the groove 61 was set to be 20 μm. Then, the core losses in the various grain-oriented electrical steel plates in which the maximum values of the tensile stress 64 differed were measured. A result thereof is shown in FIG. 8. FIG. 8 is a graph showing relationships between the maximum values of the tensile stress and the core losses in the grain-oriented electrical steel plates in which the tensile stresses are applied to the vicinity of the groove. Incidentally, marks ○ in FIG. 8 indicate the core losses of the conventional grain-oriented electrical steel plate in which the formation of a groove and the coating of a film were performed, and marks □ indicate the core losses of the conventional electrical steel plate in which the introduction of strain by emitting the laser beam and the coating of a film were performed without forming a groove.

From the result shown in FIG. 8, it is found that the core loss is reduced in particular in a range where the maximum value of the tensile stress to be applied to the surface layer is from 20 MPa to 300 MPa. When the maximum value of the tensile stress exceeds 300 MPa, the core loss is increased. This is because the grain-oriented electrical steel plate approaches a yield point, a region where a plastic strain occurs is increased, and a hysteresis loss is increased due to an effect of pinning of a magnetic domain wall.

Thus, in the present invention, the maximum value of the tensile stress to be applied is set to be 20 MPa to 300 MPa.

Incidentally, the stresses acting on the grain-oriented electrical steel plate in which the formation of a groove and the application of tension by a film are combined correspond to the external tension of approximately 5 MPa as described above, and a value of the above is similar to that within the ranges of 100 μm from the side surfaces of the groove as well. That is, the value is extremely low as compared with a tensile tension to be prescribed in the present invention.

Figure 9:
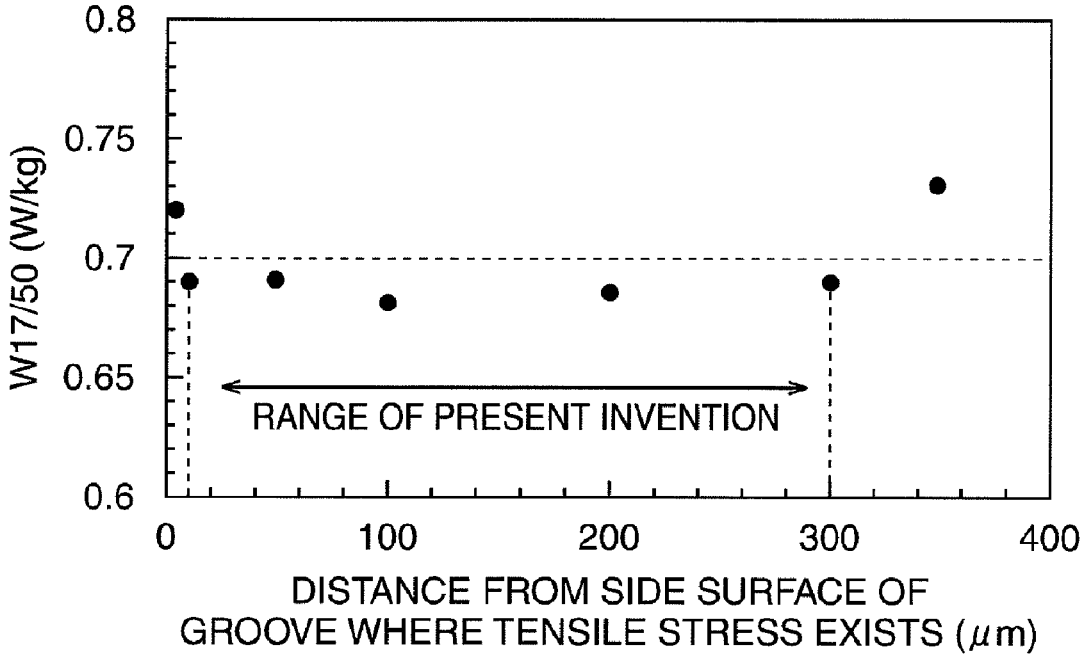
FIG. 9 is a graph showing a relationship between a distance of a region where a tensile stress exists from a side surface of a groove and a core loss.

The present inventors investigated a relationship between a range where a tensile stress acts and a core loss in a grain-oriented electrical steel plate in which tensile stresses are applied to the vicinity of a groove. In this investigation, in manufacturing the grain-oriented electrical steel plates, the groove 61 was formed and the tensile stresses 64 were applied, by a method similar to that of the above-described investigation. Here, the width of the groove 61 was set to be 100 μm, the depth of the groove 61 was set to be 20 μm, and the maximum value of the tensile stress 64 was set to be 150 MPa. Then, the core losses in the various grain-oriented electrical steel plates in which the ranges where the tensile stresses 64 acted differed were measured. A result thereof is shown in FIG. 9. FIG. 9 is a graph showing relationships between the ranges where the tensile stresses act and the core losses in the grain-oriented electrical steel plates in which the tensile stresses are applied to the vicinity of the groove.

From FIG. 9, it is found that the core loss is reduced in particular in ranges where distances of the regions where the tensile stresses act are 10 μm to 300 μm from the side surfaces of the groove. When the ranges where the tensile stresses act exceed 300 μm from the side surfaces of the groove, the core loss is increased. This is because the regions where the tensile stresses act are increased, pinning of a magnetic domain wall is increased, and a hysteresis loss is increased. Further, the core loss is also increased in ranges where the distances are less than 10 μm from the side surfaces of the groove. This is because the ranges where the tensile stresses act are so narrow that magnetic poles do not occur strongly.

Thus, in the present invention, the ranges where the tensile stresses act are set to be 10 μm to 300 μm from the side surfaces of the groove.

Figure 10:
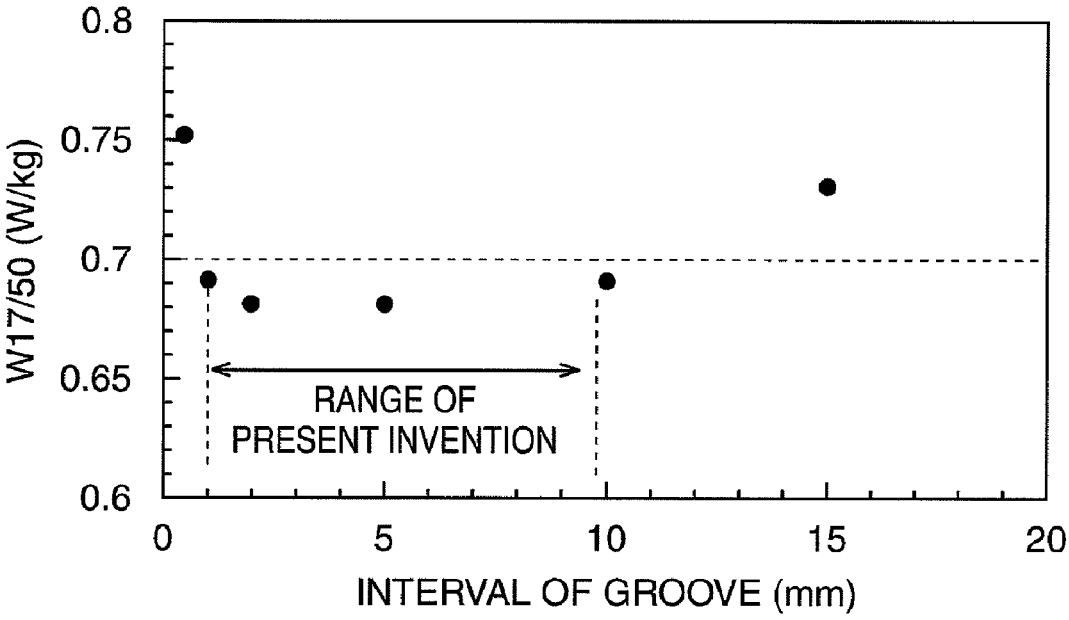
FIG. 10 is a graph showing a relationship between an interval of grooves and a core loss.

The present inventors investigated a relationship between an interval of grooves and a core loss in a grain-oriented electrical steel plate in which tensile stresses are applied to the vicinity of the groove. In this investigation, in manufacturing the grain-oriented electrical steel plates, the groove 61 was formed and the tensile stresses 64 were applied, by a method similar to that of the above-described investigation. Here, the width of the groove 61 was set to be 100 μm, the depth of the groove 61 was set to be 20 μm, and the maximum value of the tensile stress was set to be 150 MPa. Then, the core losses in the various grain-oriented electrical steel plates in which the intervals of the groove 61 differed were measured. A result thereof is shown in FIG. 10. FIG. 10 is a graph showing relationships between the intervals of the groove and the core losses in the grain-oriented electrical steel plates in which the tensile stresses are applied to the vicinity of the groove.

From FIG. 10, it is found that the core loss is reduced in particular in a range where the interval of the groove is 1 mm to 10 mm. When the interval of the groove is less than 1 mm, the core loss is increased. This is because a ratio of the region where the tensile stress acts to the entire grain-oriented electrical steel plate is so increased that a hysteresis loss is increased due to an effect of pinning of a magnetic domain wall. Further, when the interval of the groove also exceeds 10 mm, the core loss is increased. This is because subdivision of 180-degree magnetic domains with the formation of the groove is not performed sufficiently.

Thus, in the present invention, the interval of the groove is set to be 1 mm to 10 mm.

Figure 11:
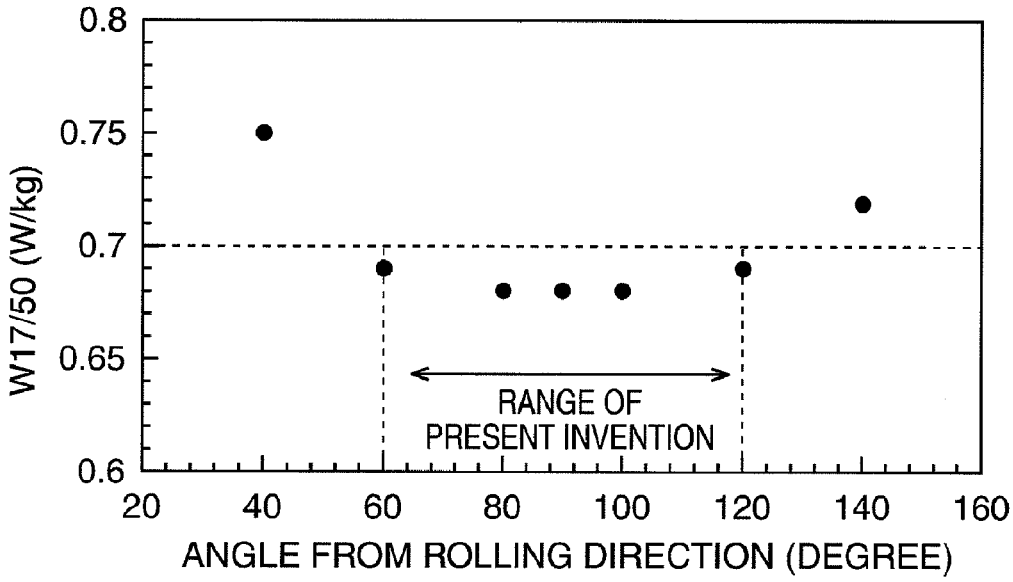
FIG. 11 is a graph showing a relationship between an angle between a direction in which a groove extends and a rolling direction, and a core loss.

The present inventors investigated a relationship between a direction in which a groove extends and a core loss in a grain-oriented electrical steel plate in which tensile stresses are applied to the vicinity of the groove. In this investigation, in manufacturing the grain-oriented electrical steel plates, the groove 61 was formed and the tensile stresses 64 were applied, by a method similar to that of the above-described investigation. Here, the width of the groove 61 was set to be 100 μm, the depth of the groove 61 was set to be 20 μm, the interval of the groove 61 was set to be 5 mm, and the maximum value of the tensile stress is set to be 150 MPa. Then, the core losses in the various grain-oriented electrical steel plates in which the directions in which the groove extended (angles between the direction in which the groove extends and the rolling direction) differed were measured. A result thereof is shown in FIG. 11. FIG. 11 is a graph showing relationships between the directions in which the groove extends and the core losses in the grain-oriented electrical steel plates in which the tensile stresses are applied to the vicinity of the groove.

Figure 12:
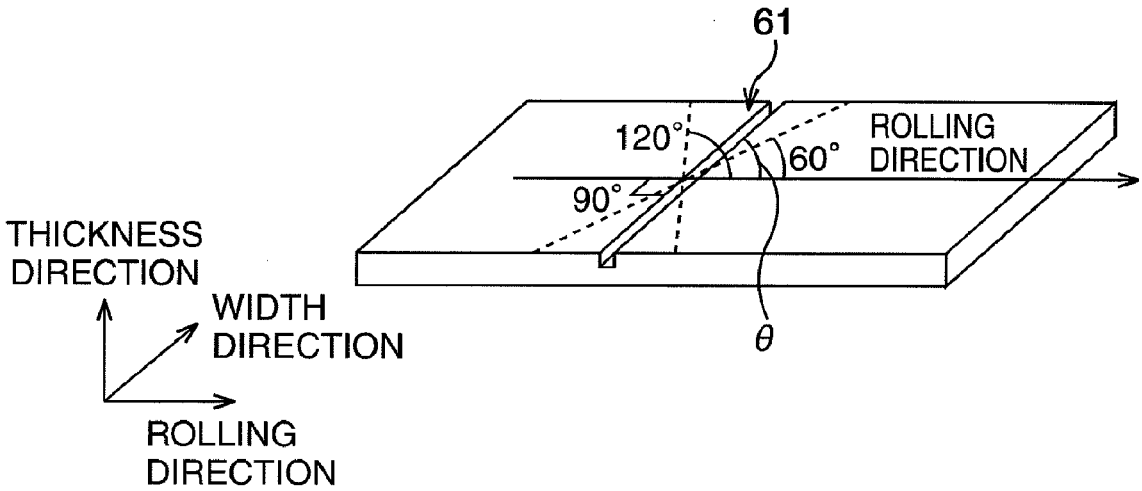
FIG. 12 is a view showing a relationship between a direction in which a groove extends and a rolling direction.

From FIG. 11, it is found that the core loss is reduced in particular in a range where the angle between the direction in which the groove extends and the rolling direction is 60 degrees to 120 degrees, and the core loss is further reduced in a range of 80 degrees to 100 degrees. An angle θ between the direction in which the groove extends and the rolling direction is expressed as shown in FIG. 12. Then, the above-described range of 60 degrees to 120 degrees corresponds to a range where a deviation from an easy magnetization axis direction, namely a direction perpendicular to the rolling direction, (which is a plate thickness direction), is within 30 degrees. Then, when the angle θ is less than 60 degrees or the angle θ exceeds 120 degrees, the proportion in which magnetizations toward the rolling direction pass through a side surface of the groove is reduced and subdivision of magnetic domains is not performed sufficiently, resulting that the core loss is increased.

From these reasons, in the present invention, the width of the groove is set to be 10 μm to 200 μm, the depth of the groove is set to be 10 μm to 30 μm, the angle between the direction in which the groove extends and the rolling direction is set to be 60 degrees to 120 degrees, and the interval of the groove is set to be 1 mm to 10 mm. Further, on the regions of the ranges of 10 μm to 300 μm from the side surfaces of the groove, the tensile stresses having the maximum value of 20 MPa to 300 MPa act in the rolling direction.

Note that the method to form the groove is not limited in particular, and for example, a process using a gear, a presswork, a process by etching, cut by machining, electronic discharge machining, and so on can be cited. Further, a cross section of the groove is also not limited in particular, and for example, a rectangle, a trapezoid, and a shape in which a rectangle, a trapezoid, or the like is distorted, and so on can be cited. In either way, it is enough that a recessed-shaped groove is formed in a surface of a grain-oriented electrical steel plate.

Figure 13A:
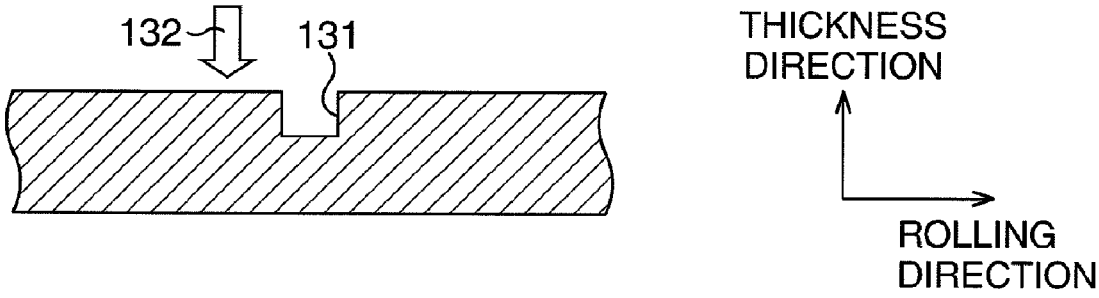
FIG. 13A is a view showing an example of a region to be irradiated with a laser beam.
Figure 13B:
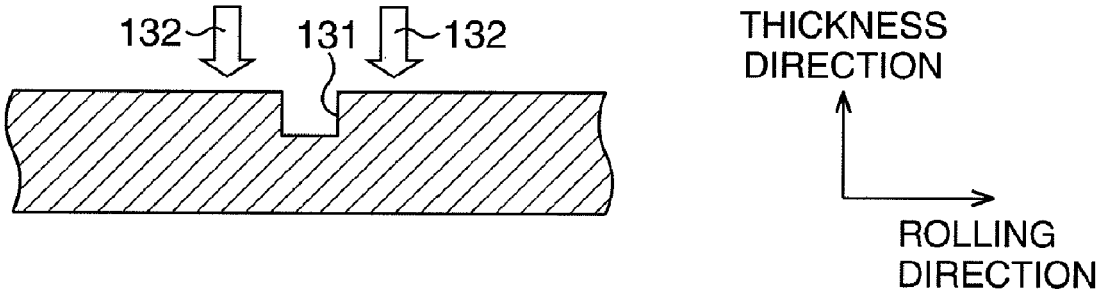
FIG. 13B is a view showing another example of a region to be irradiated with a laser beam.
Figure 13C:
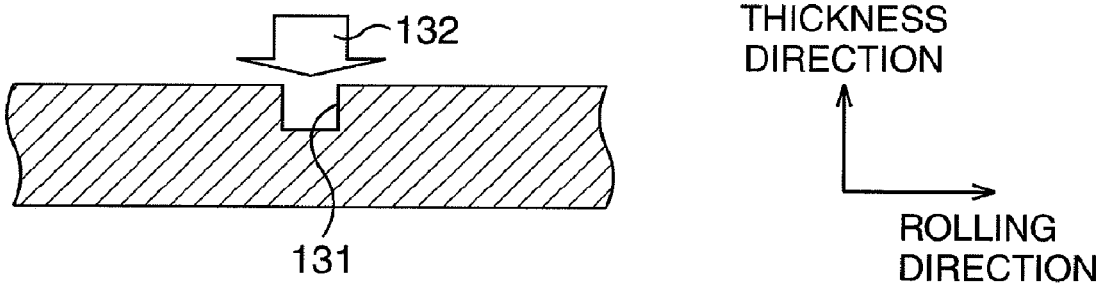
FIG. 13C is a view showing still another example of a region to be irradiated with a laser beam.

Further, the method to apply the tensile stress is not limited in particular, and local heating using microwaves or the like, an ion implantation method, and so on can be cited. In either way, it is enough that tensile stresses should be applied to predetermined regions of a surface layer of a grain-oriented electrical steel plate. In the case when tensile stresses are applied by emitting a laser beam, a method thereof is not limited in particular, and for example, pulse emitting, continuous emitting, and combined emitting of the pulse emitting and the continuous emitting can be cited. Further, the ranges where external stresses are applied may be continuous or may be discontinuous, along the side surfaces of the groove. Further, in the case when tensile stresses are applied by emitting a laser beam 132, a region irradiated with the laser beam 132 may be one side of a groove 131 as shown in FIG. 13A, or may be both sides of the groove 131 as shown in FIG. 13B. Further, as shown in FIG. 13C, the laser beam 132 may also be emitted to cover the groove 131. Similarly, in the case when tensile stresses are applied by using microwaves or ion implantation as well, a region where the processing is performed may be one side of a groove or both sides of the groove, and further the processing may also be performed to cover the groove.

In a case when a grain-oriented electrical steel plate is manufactured on a manufacturing level, it is preferable that the formation of a groove and the application of tensile stresses are performed while the grain-oriented electrical steel plate is rolled up in a coil shape. In this case, the processing is performed in the grain-oriented electrical steel plate rolling at a rolling up speed. Thus, in order to form a groove and apply tensile stresses so that the above-described conditions are met, a method such that adjustment of a position is easy to be performed and strength of tensile stresses to be applied is easy to be controlled is more preferable. For this reason, it is preferable that the application of tensile stresses is performed by emission of a laser beam. This is because according to the emission of the laser beam, a maximum value of the tensile stress can be controlled easily by adjustment of power of laser output or the like.

Incidentally, the laser output is sufficient to the extent that predetermined tensile stresses can be applied, and the emission energy Ua is preferable to be equal to or less than 6 mJ/mm$^2$. When the emission energy Ua exceeds 6 mJ/mm$^2$, there is sometimes a case that a new flaw is caused in the front surface of the grain-oriented electrical steel plate to change a property. Further, in order to apply the tensile stresses to the regions of the ranges of 10 μm to 300 μm from the side surfaces of the groove, positions irradiated with a laser beam is preferable to be within 300 μm from the side surfaces of the groove and are more preferable to be within 100 μm.

described above. Further, a value of the core loss is a value measured with using a single plate magnetic apparatus, in a case when a frequency was 50 Hz and a magnetic flux density was 1.7 T.

As is clear from Table 2, the grain-oriented electrical steel plates in tests No. 1 to No. 4 (examples) fell within the range prescribed in the present invention, so that the low core loss, which is less than 0.7 W/kg, was obtained. In contrast, in the grain-oriented electrical steel plates in tests No. 5 and No. 6 (comparative examples), which were out of the range prescribed in the present invention, the core loss was higher than the examples.

TABLE 1

| | Test No. | Width of groove (μm) | Depth of groove (μm) | Angle from rolling direction of groove (degree) | Interval of groove (mm) |
|---|---|---|---|---|---|
| Example | 1 | 100 | 20 | 90 | 5 |
| Example | 2 | 100 | 25 | 90 | 5 |
| Example | 3 | 100 | 20 | 90 | 3 |
| Example | 4 | 150 | 20 | 95 | 3 |
| Comparative example | 5 | 100 | 20 | 90 | 5 |
| Comparative example | 6 | 100 | 20 | 90 | 5 |

TABLE 2

| | Test No. | Emission energy Ua (mJ/mm$^2$) | Diameter of condensing spot (mm) | Maximum value of tensile stress (MPa) | Distance of region where tensile stress is applied from side surface of groove (μm) | Core loss value W17/50 (W/kg) |
|---|---|---|---|---|---|---|
| Example | 1 | 2.2 | 0.2 | 120 | 100 | 0.68 |
| Example | 2 | 2.0 | 0.2 | 110 | 60 | 0.67 |
| Example | 3 | 2.0 | 0.2 | 110 | 80 | 0.67 |
| Example | 4 | 2.0 | 0.2 | 110 | 80 | 0.68 |
| Comparative example | 5 | 0.2 | 0.2 | 10 | 15 | 0.72 |
| Comparative example | 6 | 2.5 | 0.2 | 130 | 350 | 0.73 |

FIRST EXPERIMENT

Next, a first experiment that the present inventors actually conducted, for confirming the effect of the present invention will be explained. In the first experiment, first, grain-oriented electrical steel plates containing Si of about 3 mass % and with a remaining portion being made of Fe and impurities and having a thickness of 0.23 mm were manufactured. Thereafter, a resist was coated on and grooves in a shape shown in Table 1 were formed by wet etching in a surface of the grain-oriented electrical steel plate. Next, the YAG pulse laser beams were emitted to the vicinity of the grooves while the emission energy Ua and emission positions were adjusted, and tensile stresses shown in Table 2 were applied. As shown in Table 2 below, the emission energy was set to be 0.2 mJ/mm$^2$ to 2.5 mJ/mm$^2$, and the emission positions were set to be 15 μm to 350 μm from side surfaces of the grooves. Then, a core loss W17/50 of each of the grain-oriented electrical steel plates was measured. Incidentally, a maximum value of the tensile stress in Table 2 is a value obtained in a manner that a distortion of a crystal lattice was measured by an X-ray diffractometry and conversion using a physical property value such as an elastic modulus was performed as

SECOND EXPERIMENT

Next, a second experiment that the present inventors actually conducted, for confirming the effect of the present invention will be explained. In the second experiment, first, grain-oriented electrical steel plates containing Si of about 3 mass % and with a remaining portion being made of Fe and impurities and having a thickness of 0.23 mm were manufactured. Thereafter, in a surface of the grain-oriented electrical steel plate, grooves in a shape shown in Table 3 were formed by a process using a gear or a presswork. Next, strain relief annealing was performed at 800° C. for two hours. Then, the YAG pulse laser beams were emitted to regions of ranges of 80 μm from side surfaces of the grooves, and tensile stresses shown in Table 4 were applied. Further, for a comparison purpose, grain-oriented electrical steel plates made in a manner that grooves were formed by a process using a gear or a presswork and then only strain relief annealing was performed were also manufactured. Then, a core loss W17/50 of each of the grain-oriented electrical steel plates was measured. Incidentally, a maximum value of the tensile stress in Table 4 is a value obtained in a manner that a distortion of a crystal lattice was measured by an X-ray diffractometry and conversion using a physical property value such as an elastic modulus was performed as described above. Further, a value of the core loss is a value measured by using a single plate magnetic apparatus, in a case when a frequency was 50 Hz and a magnetic flux density was 1.7 T.

As is clear from Table 4, the grain-oriented electrical steel plates in tests No. 11 and No. 12 (examples) fell within the range prescribed in the present invention, so that the low core loss, which is less than 0.7 W/kg, was obtained. In contrast, in the grain-oriented electrical steel plates in tests No. 13 and No. 14 (comparative examples), which were out of the range prescribed in the present invention, the core loss was higher than the examples.

TABLE 3

| | Test No. | Width of groove (μm) | Depth of groove (μm) | Angle from rolling direction of groove (degree) | Groove interval (mm) | Note (groove forming method) |
|---|---|---|---|---|---|---|
| Example | 11 | 100 | 25 | 90 | 5 | gear |
| Example | 12 | 100 | 25 | 90 | 5 | press |
| Comparative example | 13 | 100 | 25 | 90 | 5 | gear |
| Comparative Example | 14 | 100 | 25 | 90 | 5 | press |

TABLE 4

| | Test No. | Emission energy Ua (mJ/mm$^2$) | Diameter of condensing spot (mm) | Maximum value of tensile stress (MPa) | Distance of region where tensile stress is applied from side surface of groove (μm) | Core loss value W17/50 (W/kg) |
|---|---|---|---|---|---|---|
| Example | 11 | 2.1 | 0.2 | 115 | 80 | 0.67 |
| Example | 12 | 2.1 | 0.2 | 115 | 80 | 0.68 |
| Comparative example | 13 | — | — | — | — | 0.74 |
| Comparative example | 13 | — | — | — | — | 0.75 |

INDUSTRIAL APPLICABILITY

According to the present invention, it is possible to obtain a sufficiently low core loss even though tension acting from a film coated on a front surface is not sufficient.

What is claimed is:

1. A grain-oriented electrical steel plate comprising:

a steel plate having a front surface and a rear surface, wherein at least one of the front surface and the rear surface has grooves having a width of 10 μm to 200 μm and a depth of 10 μm to 30 μm at intervals of 1 mm to 10 mm, the grain-oriented electrical steel plate is obtained by rolling the steel plate so that an angle between a direction in which the grooves extend and a rolling direction of the steel plate is 60 degrees to 120 degrees, and wherein differing tensile stresses arc generated in the steel plate, wherein the portion(s) having the maximum tensile stress are located within 10 μm to 300 μm from side surfaces of the grooves and have a value of 20 MPa to 300 MPa.

2. The grain-oriented electrical steel plate according to claim 1, wherein the tensile stresses are applied by emission of a laser beam.

3. A method of manufacturing a grain-oriented electrical steel plate comprising:

rolling a steel plate having a front surface and a rear surface;

forming grooves having a width of 10 μm to 200 μm and a depth of 10 μm to 30 μm at intervals of 1 mm to 10 mm on at least one of the front surface and the rear surface of the steel plate, so that an angle between a direction in which the grooves extend and a rolling direction of the steel plate is 60 degrees to 120 degrees; and irradiating the surface of the steel plate where the grooves are formed with a laser beam to give the grain-oriented electrical steel plate, wherein the grain-oriented electrical steel plate has differing tensile stresses generated within the steel plate and the maximum tensile stress of the steel plate is located within 10 μm to 300 μm from side surfaces of the grooves and has a value of 20 MPa to 300 MPa.

4. The method of manufacturing the grain-oriented electrical steel plate according to claim 3, wherein the laser beam is emitted within a range from the side surface of the grooves to 300 μm.

5. The method of manufacturing the grain-oriented electrical steel plate according to claim 3, wherein the laser beam is emitted to such an extent that another groove is not formed in the front surface of the steel plate.

6. The method of manufacturing the grain-oriented electrical steel plate according to claim 4, wherein the laser beam is emitted to such an extent that another groove is not formed in the front surface of the steel plate.

7. The method of manufacturing the grain-oriented electrical steel plate according to claim 5, wherein the laser beam is emitted with emission energy that is equal to or less than 6 mJ/mm$^2$.

8. The method of manufacturing the grain-oriented electrical steel plate according to claim 6, wherein the laser beam is emitted with emission energy that is equal to or less than 6 mJ/mm$^2$.

* * * * *